United States Patent [19]

Messmer et al.

[11] Patent Number: 5,050,392

[45] Date of Patent: Sep. 24, 1991

[54] REFRIGERATION SYSTEM

[75] Inventors: Craig S. Messmer, St. Louis; Glenn A. Anderson, St. Charles, both of Mo.

[73] Assignee: McDonnell Douglas Corporation, St. Louis, Mo.

[21] Appl. No.: 535,317

[22] Filed: Jun. 8, 1990

[51] Int. Cl.[5] ..... F25B 1/00

[52] U.S. Cl. ..... 62/114; 62/121; 62/203; 62/228.3; 62/310; 62/434; 62/502; 62/512

[58] Field of Search ..... 62/114, 117, 118, 121, 62/122, 175, 190, 192, 84, 203, 207, 226, 227, 228.1, 228.3, 228.4, 228.5, 208, 209, 304, 310, 434, 502, 512, DIG. 2

[56] References Cited

U.S. PATENT DOCUMENTS

| | | | |
|---|---|---|---|
| 3,159,008 | 12/1964 | Nebgen | 62/512 X |
| 3,277,659 | 10/1966 | Sylvan et al. | 62/114 |
| 4,078,392 | 3/1978 | Kestner | 62/114 X |
| 4,180,123 | 12/1979 | Dixon | 62/114 X |
| 4,251,998 | 2/1981 | Hosterman | 62/114 X |
| 4,466,253 | 8/1984 | Jaster | 62/512 X |
| 4,689,964 | 9/1987 | St. Pierre | 62/502 X |
| 4,724,679 | 2/1988 | Radermacher | 62/114 X |

*Primary Examiner*—Harry B. Tanner

*Attorney, Agent, or Firm*—Benjamin Hudson, Jr.; Timothy H. Courson; Guy R. Gosnell

[57] ABSTRACT

There is provided by this invention a method and an apparatus for cooling a heat load that is operable in zero gravity conditions and while in any orientation due to the design of the apparatus. The apparatus' components are also selected so as to comprise a lightweight refrigeration system. The apparatus utilizes direct contact between two fluids, a liquid coolant and a refrigerant, with widely different vapor pressures so that one fluid, the coolant, always remains a liquid in the system. The two fluids may be totally or partially soluble in one another or they may be totally insoluble in one another with the degree of solubility affecting the system's efficiency, but not its reliable operation. The refrigerant, which boils and condenses during the refrigeration cycle, is mixed with the coolant and condensed prior to the portion of the system's cycle in which the heat is rejected to a heat sink and is subsequently separated from the coolant. Furthermore, the coolant in the system, which absorbs heat from the load and subsequently mixes with the refrigerant, remains a liquid throughout the system's cycle so as to provide lubrication for the system's components without the use of an additional refrigerant oil.

19 Claims, 3 Drawing Sheets

REFRIGERATION SYSTEM

BACKGROUND OF THE INVENTION

1. Field of the Invention

This invention relates generally to a method and a system for cooling a heat load, and more particularly to a method and a system for cooling a heat load utilizing direct contact between a liquid coolant and a refrigerant which may be operated in any orientation and under any gravitational situation.

2. Brief Description of the Prior Art

Applications for refrigeration systems have steadily increased and become more demanding. Currently, aerospace refrigeration systems are needed which can provide cooling in situations where there is zero gravity or high gravity or when in any orientation. Additionally, refrigeration systems are needed which are smaller and lighter.

Disclosed in U.S. Pat. No. 4,078,392 (hereinafter '392) issued to Mark O. Kestner on Mar. 14, 1978 is a refrigeration system that utilizes direct contact heat transfer between a refrigerant and a magnetic coolant. The coolant absorbs the cooling load and the refrigerant chills the coolant by direct mixing such that the refrigerant is vaporized. However, the system requires that the fluids be immiscible so that they may be separated by using buoyancy forces and that the first fluid be ferromagnetic so as to allow their separation to be assisted by a magnetic field. Also, the mixing and the separation of the fluids occur within the same system component and gravity is required for correct system performance. Furthermore, the '392 system requires a two-phase condenser which is orientation-dependent.

A method of refrigeration is disclosed by S. G. Sylvan in U.S. Pat. No. 3,277,659 which issued on Oct. 11, 1966. The refrigeration method utilizes two fluids, a refrigerant and a coolant. The liquid coolant is injected into the refrigerant gas before its entry into the compressor to allow isothermal compression. However, only the refrigerant absorbs or rejects heat and the method still utilizes the conventional condensing and evaporating steps which require gravity in order to separate the liquid and the gas refrigerant.

An additional refrigeration method and system is disclosed by Michael St. Pierre in U.S. Pat. No. 4,689,964 (hereinafter '964) which issued on Sept. 1, 1987. The refrigeration method and system of the '964 patent is operable in zero gravity situations and achieves its cooling by the circulation of two different refrigerants within its system. However, the two refrigerants both boil and condense inside of the two-phase heat exchangers which are orientation-dependent in the refrigeration system of the '964 patent. Additionally, a separate refrigerant oil is necessary to provide lubrication to the system's components.

The heat pump cycle disclosed by Reinhard Radermacher in U.S. Pat. No. 4,724,679 (hereinafter '679) which issued on Feb. 16, 1988 utilizes a combination of two refrigerants for circulation within the system. The refrigerants are required to have widely different boiling points so that one of the refrigerants does not boil, but remains a liquid throughout the system. The system and method disclosed in the '679 patent, however, requires the use of two soluble fluids and thus the selection of applicable circulating refrigerants is limited to those which are completely soluble in one another. The system requires heat to be added in the desorber in order to vaporize the refrigerant and to cool the heat load. The desorber, though, is a two-phase device which is highly dependent on orientation. Additionally, the heat pump cycle disclosed in the '679 patent requires gravity to operate the adsorber, a two-phase heat exchanger, so that only liquid exits the adsorber instead of gas which would exit if the adsorber were inverted. Thus, the heat pump cycle can not properly function in all orientations.

It would be desirable to develop a refrigeration system which could operate in zero gravity or high gravity situations, as well as a system which could utilize one of its circulating components, which may be completely or partially soluble or totally insoluble in the other component, to provide lubrication so as to forego the use of a separate refrigerant oil. It would also be desirable to cool one or many heat loads with one of the system's components which would remain liquid so as to reduce the likelihood of gaseous leaks since a liquid is more reliably contained under pressure. Furthermore, it would be desirable for a refrigeration system to be designed so as to be lightweight and to maintain the minimum system pressure necessary for increased efficiency.

SUMMARY OF THE INVENTION

There is provided by this invention a method and a system for cooling a heat load utilizing direct contact between two fluids, a liquid coolant and a refrigerant, with widely different vapor pressures so that one fluid, the coolant, always remains a liquid in the system. The two fluids may be totally or partially soluble in one another or they may be totally insoluble in one another with the degree of solubility affecting the system's efficiency, but not its reliable operation. The system's components are designed so that the system is capable of operating in zero gravity or high gravity situations or when the system is positioned in any orientation. The system's components are also selected so as to comprise a lightweight refrigeration system. The coolant in the system, which absorbs heat from the load and subsequently mixes with the refrigerant, remains a liquid throughout the system's cycle so as to provide lubrication for the system's components without the use of an additional refrigerant oil. The refrigerant, which boils and condenses during the refrigeration cycle, is mixed with the coolant and condensed prior to the portion of the system's cycle in which the heat is rejected to a heat sink and is subsequently separated from the coolant. Additionally, a control circuit may be coupled with the refrigeration system to maintain the minimum pressure necessary for rejecting the heat load to the heat sink so as to obtain greater system efficiency.

DETAILED DESCRIPTION OF THE PREFERRED EMBODIMENT

Figure 1:
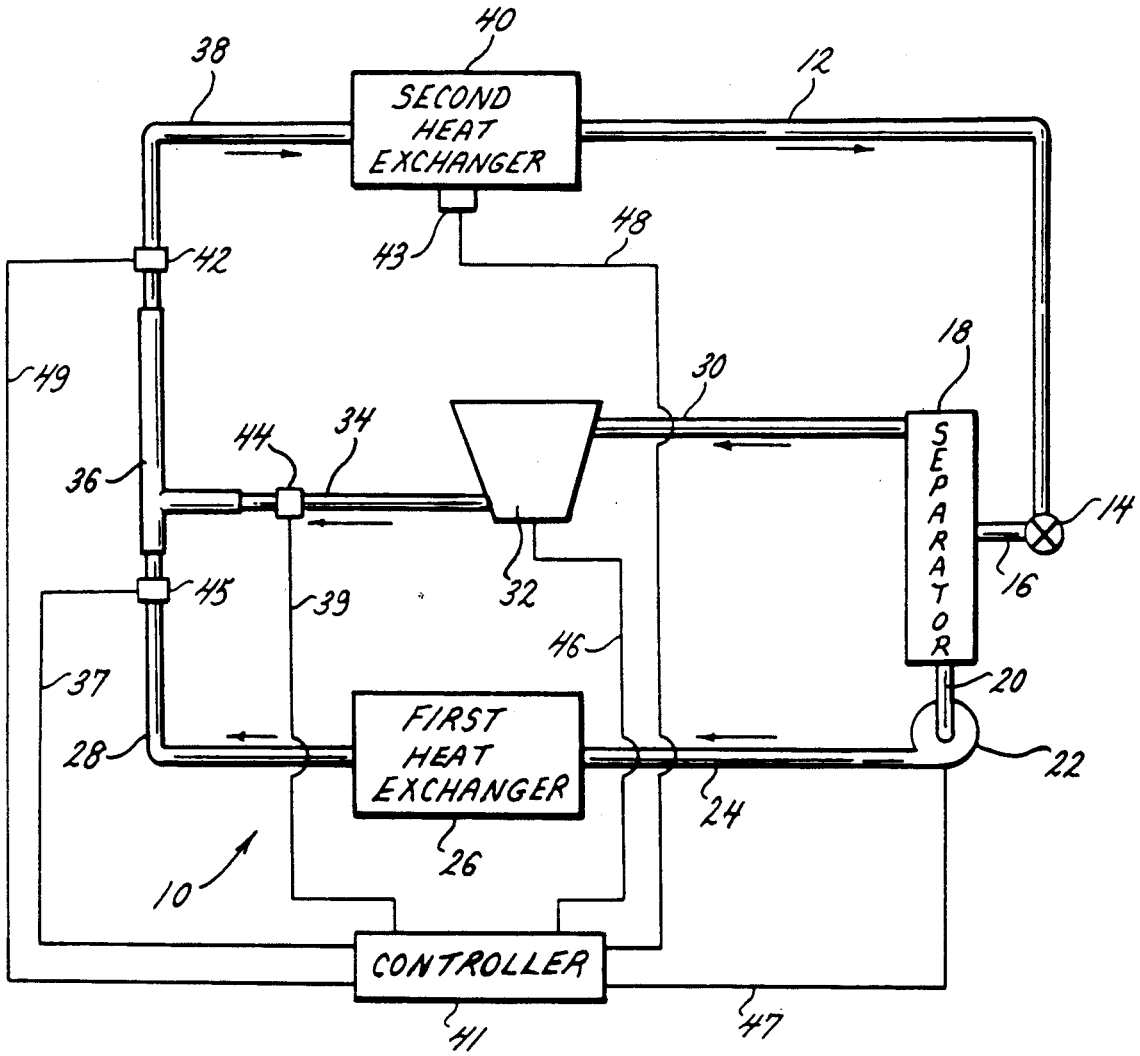
FIG. 1 is a schematic representation of the system incorporating the principles of this invention.

Referring to FIG. 1, there is shown a system 10 for cooling a load incorporating the principles of this invention. The system 10 utilizes two fluids, a coolant which remains a liquid throughout the system's cycle and a refrigerant which is partially vaporized during a portion of the cycle. For best performance, the refrigerant should have a low vapor pressure, such as below 1000 psia, to allow the use of lightweight materials. Also, the refrigerant's critical temperature must be greater than the temperature of the heat sink so that the cooling load can be absorbed by the heat sink by subcooling the mixture of refrigerant and coolant. Additionally, the system is more efficient when the critical temperature is much higher than the heat sink's temperature. An exemplary refrigerant is chlorodifluoromethane, commonly known as Refrigerant 22 (hereinafter R22), which has a critical pressure of 722 psia and a critical temperature of 205° F.

The coolant should be selected so as to be chemically inert with the refrigerant. The coolant vapor pressure should be much lower than the refrigerant vapor pressure, at least by a magnitude of 10 lower, so that the coolant remains a liquid throughout the system and does not depress the refrigerant vapor pressure when they are mixed together. Additionally, the coolant should be a good lubricant to eliminate the need for additional refrigeration oil. An exemplary fluid is Polyalphaolefin (hereinafter PAO) which is a synthetic oil with a vapor pressure of 9 Torr at 149° F.

The refrigerant and the coolant selected for proper system operation may be either totally or partially soluble, or totally insoluble in one another. For example, system performance may be altered by selecting a totally soluble pair of compounds which will optimize the mixer's efficiency while impairing the efficiency of the separator. Alternatively, if a totally insoluble pair of compounds is selected, the separator's efficiency will be increased, but the mixer's efficiency will be decreased. By allowing the use of fluids which are totally or partially soluble in one another as well as fluids which are totally insoluble in one another, the range of possible fluids is greatly enhanced over prior art systems which restricted the choices of refrigerants and coolants to those which are totally soluble in one another as well as prior art systems which restricted the choices of refrigerants and coolants to those which are partially soluble in one another and prior art systems which required the circulating fluids to be totally insoluble in one another.

Exemplary temperature and pressure ranges are given throughout the following description of the system 10. These ranges are for an typical system utilizing PAO as a coolant and R22 as a refrigerant; however, it should be noted that the use of these particular fluids is solely for the purpose of example and alternative fluids could be substituted by those skilled in the art without departing from the spirit and scope of this invention.

Figure 2:
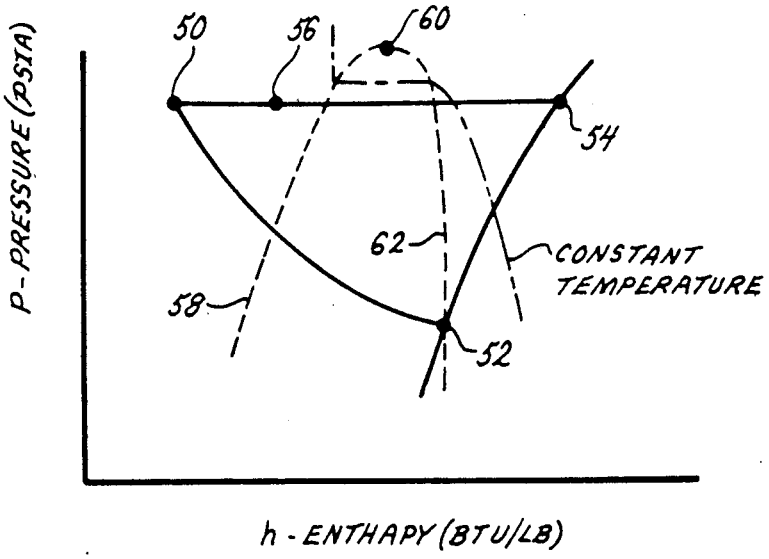
FIG. 2 is a thermodynamic diagram illustrating the pressure and enthalpy changes which occur in the refrigerant within the system incorporating the principles of this invention.

Referring again to FIG. 1, a mixture of a refrigerant and a coolant exists as a compressed or subcooled liquid in a conduit 12 at a high pressure, such as 420 psia, and a moderately-high temperature, such as 100° F. Point 50 of FIG. 2 illustrates the subcooled liquid state of the refrigerant existing in conduit 12 since enthalpy value at point 50 is less than the critical enthalpy value at the same pressure as illustrated by the saturated liquid curve 58 which exists for enthalpy values less than the critical point 60. Referring again to FIG. 1, an expansion valve 14 connects conduit 12 to a conduit 16. Expansion valve 14 reduces the pressure below the saturation pressure of the refrigerant, such as 83 psia, so as to enable some or all of the liquid refrigerant to flash to vapor, thus lowering the mixture's temperature to the refrigerant's saturation temperature, such as 40° F. when some of the refrigerant remains as a liquid, or to slightly above the refrigerant's saturation temperature, such as 50° F. when all of the refrigerant is vaporized, so as to create a superheated vapor. Since the evaporation process occurs within the conduit over a short distance, the system does not require a two-phase heat exchanger, such as an evaporator or desorber, as in the prior art systems so as to make the system lighter and more compact than the prior art systems.

Figure 3:
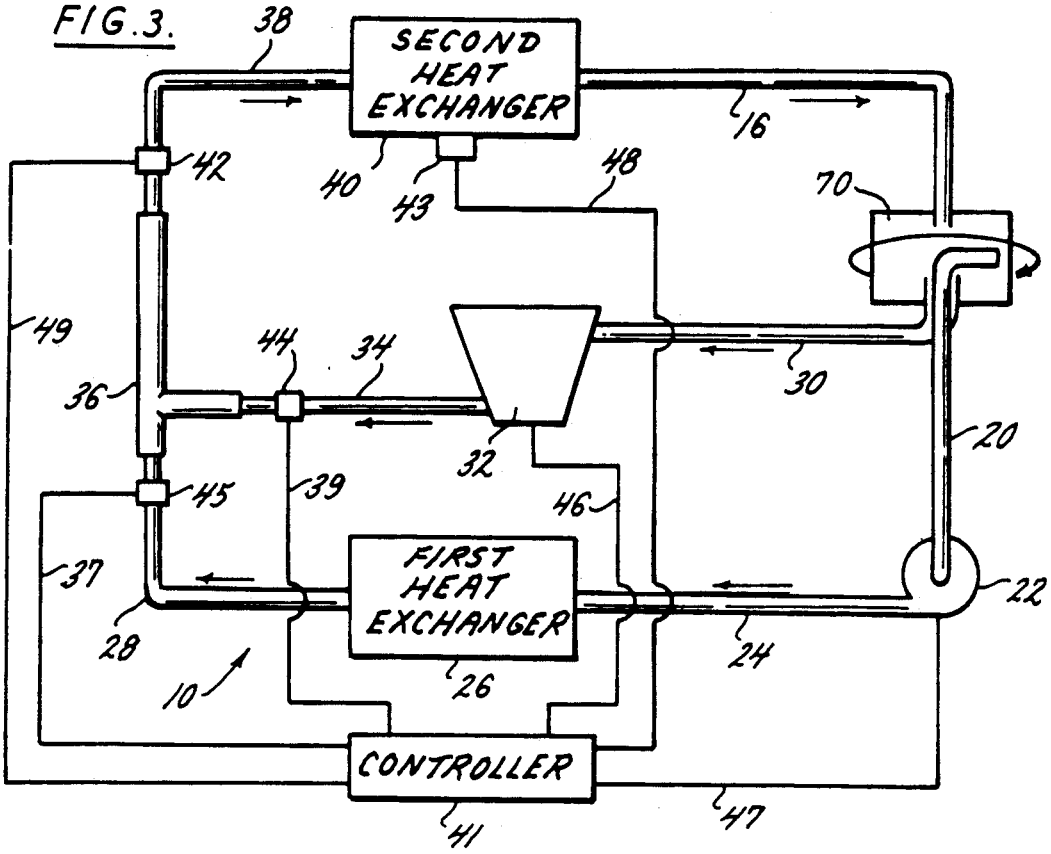
FIG. 3 is a schematical representation of the system incorporating the principles of this invention wherein a centrifuge is utilized as the separating means.
Figure 4:
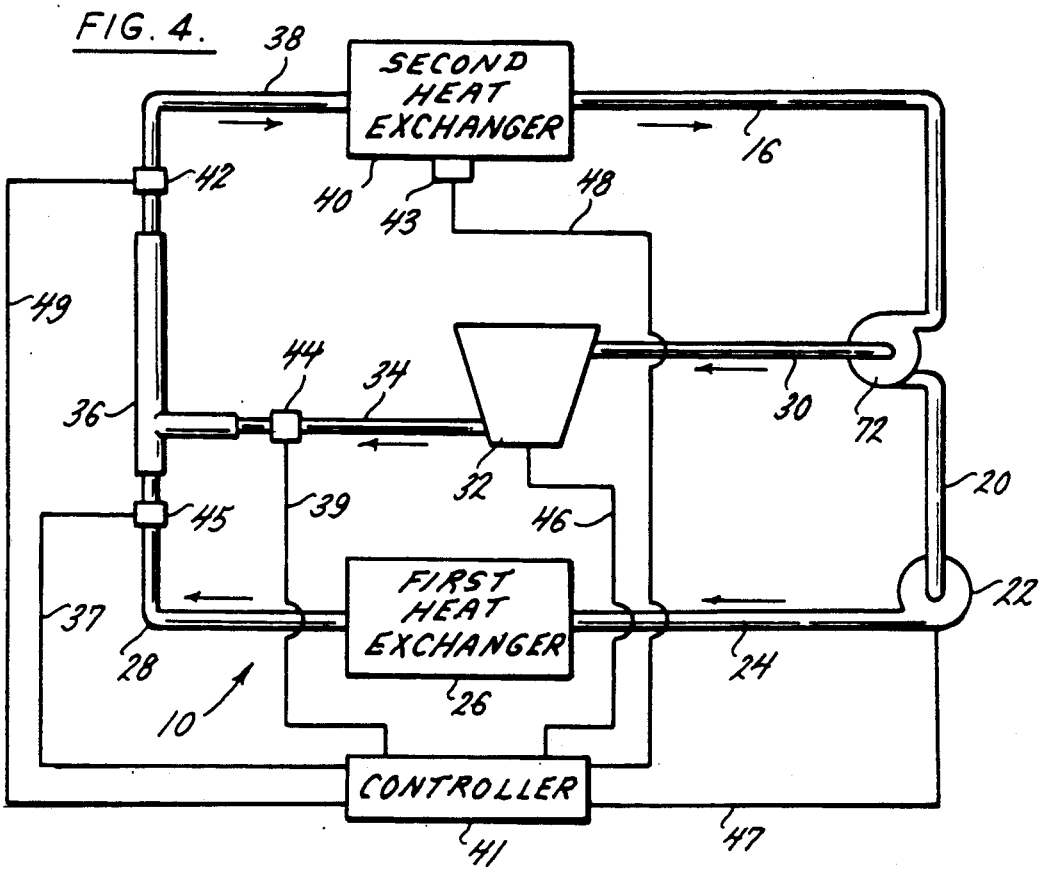
FIG. 4 is a schematical representation of the system incorporating the principles of this invention wherein a vortex flow separator is utilized as the separating means.

The mixture of coolant and refrigerant from conduit 16 flows into a separator 18 which separates the refrigerant gas and the liquid by centrifugal action, either mechanically induced or created by vortex or swirl flow. FIG. 3 illustrates a centrifuge 70 utilized as a separator, while FIG. 4 depicts the separation accomplished by means of a vortex flow separator 72. The separator will thus work in zero gravity or high gravity situations or when situated in any orientation. Therefore, chilled liquid, mostly coolant, is flowing in a conduit 20 while refrigerant gas is flowing in a conduit 30.

A pump 22 provides the motive force for the liquid coolant in conduit 20. Pump 22 adjusts its displacement so as to maintain the same high pressure in a conduit 24 as is in conduit 34. The coolant at high pressure flows through conduit 24 to a heat exchanger 26 which provides a means for the cooling load to indirectly contact the chilled liquid. Within heat exchanger 26, the chilled liquid absorbs heat from the cooling load which causes its temperature to rise. A conduit 28 carries the liquid, at a higher temperature such as 80° F., from heat exchanger 26 to a mixer 36.

Point 52 of FIG. 2 depicts the state of the refrigerant gas in the conduit 30 following its separation from the liquid coolant. The refrigerant gas in conduit 30 has greater enthalpy at a lower pressure than the liquid refrigerant had at point 50 which depicts the state of the refrigerant in conduit 12. Additionally, the refrigerant at point 52 is at the borderline of becoming a saturated vapor as noted by its location on the saturated vapor curve 62 existing for enthalpy values greater than the critical point 60. Referring to FIG. 1, the refrigerant gas in conduit 30 is carried to a compressor 32 which boosts the refrigerant gas' pressure such that its saturation temperature is greater, such as 420 psia and 202° F. respectively, as shown in FIG. 2 by point 54 which is in the region of superheated refrigerant since point 54 has a greater enthalpy than the saturated vapor curve 62 at the same pressure. The transition from point 52 to point 54 caused by the compressor 32 is a constant entropy process as shown by both points, 52 and 54, lying on the constant entropy curve 64. The output pressure of the compressor 32 is maintained constant so that the refrigerant is condensed in the coolant inside the mixer 36 and the fluid mixture in conduit 38 has a temperature sufficiently greater than that of the heat sink so as to reject the entire heat load. This higher temperature provides the requisite temperature difference for a subsequent heat transfer to an ultimate heat sink. The refrigerant gas at its increased pressure is now carried by conduit 34 to a mixer 36.

Within mixer 36, the liquid coolant and the refrigerant gas are continuously mixed in such a manner that external acceleration forces do not affect the flow or condensation of the refrigerant as is well known to those skilled in the art. An exemplary mixer is a Tee fitting with the velocity of the incoming fluids chosen so that the acceleration forces are overcome. The mixing process can be enhanced with swirl devices or filters so as to increase the turbulence and reduce the size of the refrigerant gas bubbles. The refrigerant gas is completely condensed by the liquid mixture from conduit 28 which is at a lower temperature than the refrigerant. Consequently, the mixture of the two fluids which leaves the mixer 36 through a conduit 38 is at a high temperature, such as 140° F., which is greater than the temperature of the liquid in conduit 28 but less than the temperature of the refrigerant in conduit 34. The state of the mixture within conduit 38 is illustrated in FIG. 2 by point 56 which shows a constant pressure decrease in the enthalpy, and consequently a decrease in the temperature, of the refrigerant from point 54, which depicts refrigerant within conduit 34, to point 56 which depicts refrigerant within conduit 38. The refrigerant is once again a subcooled since the enthalpy at point 56 is less than the enthalpy of the saturated liquid curve 58 at the same pressure.

The high temperature liquid mixture now is transferred through conduit 38 to a heat exchanger 40. Within heat exchanger 40, the liquid mixture is subcooled while transferring its heat to the sink. Common examples of a heat sink include fuel and external air. The liquid mixture exits heat exchanger 40 at a moderate temperature, such as 100° F., through conduit 12 so as begin the cooling process again.

The heat exchangers utilized in the system 10 may be single-phase heat exchangers which are not dependant on attitudinal and acceleration forces, whereas a two-phase heat exchanger utilized in prior art systems requires gravity to separate the gas and liquid. The single-phase heat exchangers can be used because both within the first heat exchanger 26 and the second heat exchanger 40, the mixture is completely liquid both before and after the heat transfer.

Figure 5:
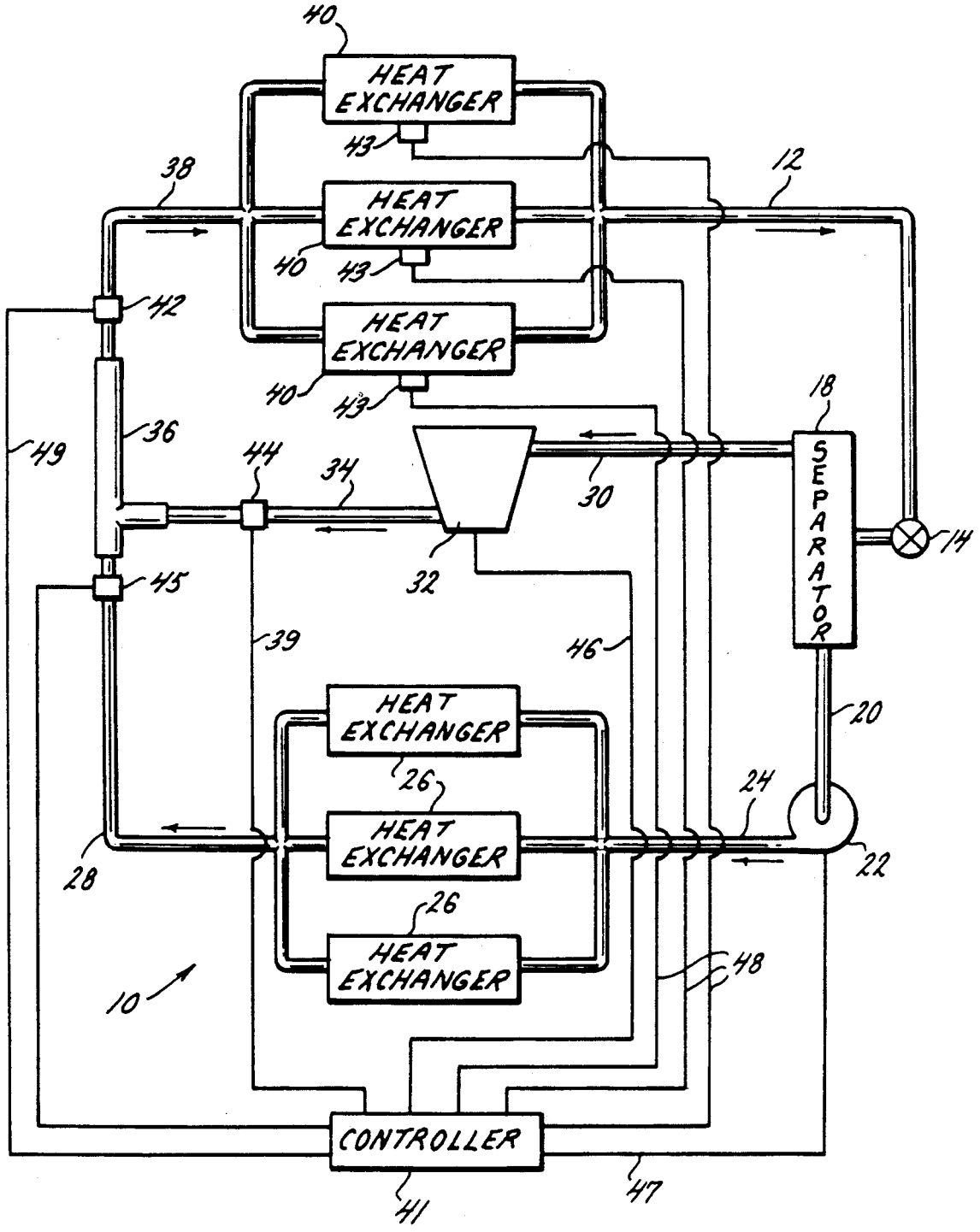
FIG. 5 is a schematical representation of the system incorporating the principles of this invention wherein a plurality of first and second heat exchange means are connected in parallel.

While FIG. 1 illustrates the system 10 with a single first heat exchanger 26 and a single second heat exchanger 40, the refrigeration system could also contain a plurality of first heat exchangers connected either in parallel or serially. Likewise, the refrigeration system could contain a plurality of second heat exchangers connected either in parallel or serially. FIG. 5 illustrates an exemplary system with a plurality of first heat exchange means 74 connected in parallel and a plurality of second heat exchange means 76, also connected in parallel. A plurality of heat exchangers could be utilized when there are multiple heat loads to be cooled or multiple heat sinks to accept heat.

As illustrated in FIG. 1, every component of the refrigeration system 10—such as expansion valve 14, separator 18, pump 22, heat exchangers 26 and 40, compressor 32, and mixer 36—is completely operable in zero gravity or high gravity situations. Thus, the gravitational limitations inherent in prior art systems which employ an evaporator and a condensor, or a desorber and an adsorber, are eliminated by refrigeration system 10, which does not contain an evaporator, condensor, desorber, or adsorber and which can operate in any gravitational situation. The replacement of an evaporator in a typical prior art refrigeration system by a separator enables the system to be lighter than such prior art systems since the separator is lighter than the evaporator.

Additionally, the use of a coolant having a viscosity similar to a refrigeration oil and an extremely low vapor pressure so that it remains a liquid throughout the refrigeration cycle enables the coolant to lubricate the system's components. The use of the coolant as a lubricant thus eliminates the need for an additional refrigerant oil which provides lubrication to be added into the system which was a limitation of the prior art.

The refrigeration system as heretofore described comprises a fixed pressure system wherein the pressures inside the conduits are held at a constant value; however, a control system may be coupled with the refrigeration system to adjust the pressure as the system requires to maintain more efficient operation. A control system may be comprised of a controller 41, a temperature sensor 42 for the mixer output conduit 38, a temperature sensor 43 for the heat sink of the second heat exchanger 40, a pressure sensor 44 for the compressor output conduit 34, and a pressure sensor 45 for the first heat exchanger output conduit 28.

For most efficient operation, the system's pressure should be the minimum necessary to allow the system to reject the heat load absorbed from the first heat exchanger 26 to the heat sink of the second heat exchanger 40. Due to the linear relationship between pressure and temperature, the minimum compressor and pump output pressure is obtained when the temperature difference between the heat sink of the second heat exchanger 40 and the fluid in the mixer output conduit 38 is the minimum necessary to reject the heat load to the heat sink. In order to control the temperature difference, and more particularly the temperature of the fluid in the mixer's output conduit 38, the temperature of the fluids entering the mixer 36 in the compressor output conduit 34 and the first heat exchanger output conduit 28 must be measured and controlled. The temperature of the fluids entering the mixer 36 is adjusted through variance of the fluids' pressure. Thus, to increase the temperature of the fluid exiting the mixer in conduit 38, the pressure of the fluid exiting the compressor in conduit 34 is increased and the pressure of the fluid exiting the first heat exchanger 26 in conduit 28 is also increased to match the pressure of the fluid in conduit 34.

The temperature of the heat sink of the second heat exchanger 40 is measured by the temperature sensor 43 and transmitted to the controller 41 via control line 48. Similarly, the temperature of the mixer's output fluid in conduit 38 is measured by the temperature sensor 42 and transmitted to the controller 41 via control line 49. The controller 41 determines the difference in the temperature readings and compares this difference to a predetermined ideal temperature difference. If the actual temperature difference is less than the ideal temperature difference, the pressure of the fluids entering the mixer 36 must be raised. Alternatively, if the actual temperature difference is greater than the ideal temperature difference, the pressure of the fluids entering the mixer 36 must be decreased. Also, the ideal temperature difference may be adjusted during the course of the system's operation to account for external variations such as an increase in the heat load of the first heat exchanger 26 or an increase or a decrease in the capacity of the heat sink of the second heat exchanger 40.

The pressure of the fluid in conduit 34 is measured by pressure sensor 44 and transmitted to the controller 41 via control line 39. Similarly, the pressure of the fluid in conduit 28 is measured by pressure sensor 45 and transmitted to the controller 41 via control line 37. Thus, the controller can determine when the pressure of the input fluids to the mixer is sufficient to maintain the predetermined ideal temperature difference. The pressure of the fluids entering the mixer is adjusted by the control signals initiated by the controller 41 and transmitted via control line 46 to the compressor 32 and via control line 47 to the pump 22. As is well known to those skilled in the art, the output pressure of a fluid exiting a compressor or a pump is adjustable. For example, as the speed, or rpm, of a centrifugal pump or compressor is increased the output pressure also increases for a given flow rate. Alternatively, a piston-actuated pump or compressor or a gear-driven pump has an increased output pressure as the displacement, or stroke, is increased for a given flow rate. Thus, the controller 41 will signal the compressor 32 to adjust its speed or displacement to vary its output pressure in accordance with the difference between the actual and ideal temperature differences. Similarly, the controller 41 will signal the pump 22 to adjust its speed or displacement to vary its output pressure so as to match the output pressure of the compressor 32. In this manner, the controller 41 can achieve increased system efficiency by maintaining the minimum system pressure necessary for rejecting the heat load to the heat sink of the second heat exchanger 40.

Although there has been illustrated and described specific detail and structure of operations, it is clearly understood that the same were merely for purposes of illustration and that changes and modifications may be readily made therein by those skilled in the art without departing from the spirit and the scope of this invention.

We claim:

1. A closed cooling system, comprising:

a) a refrigerant for circulating within the closed system;

b) a coolant for circulating within the closed system;

c) a means for separating the refrigerant from the coolant;

d) a pump means coupled to the separating means for providing motive force to the coolant;

e) a plurality of first heat exchange means connected downstream of the pump means for allowing the coolant to absorb heat from a cooling load;

f) a compression means coupled to the separating means for increasing the pressure of a vapor of a refrigerant;

g) a means, connected to both the compression means and the first heat exchange means, for mixing the vapor of the refrigerant and the coolant so as to condense the refrigerant vapor to a liquid;

h) a plurality of second heat exchange means, coupled downstream of the mixing means, for releasing heat from a mixture of the liquid refrigerant and the coolant to a heat sink; and i) a means, interconnected between the second heat exchange means and the separating means, for decreasing the pressure of a mixture of the liquid refrigerant and the coolant so as to vaporize the liquid refrigerant.

2. A closed system for cooling a load as recited in claim 1, wherein the means for decreasing the pressure is an expansion valve.

3. A closed system for cooling a load as recited in claim 1, wherein the refrigerant is Refrigerant 22.

4. A closed system for cooling a load as recited in claim 1, wherein the vapor pressure of the coolant is less that 10 Torr such that the coolant will remain in a liquid state throughout the closed system.

5. A closed system for cooling a load as recited in claim 1, wherein the coolant is Polyalphaolefin.

6. A closed system for cooling a load as recited in claim 1, wherein the separating means is mechanically induced.

7. A closed system for cooling a load as recited in claim 6, wherein the separating means is a centrifuge.

8. A closed system for cooling a load as recited in claim 6, wherein the separating means is created by vortex flow.

9. A closed system for cooling a load as recited in claim 1, further comprising:

a) a first temperature sensing means, connected to the second heat exchange means, for measuring the temperature the heat sink;

b) a second temperature sensing means, interposed between the mixing means and the second heat exchange means, for measuring the temperature of the mixture of the liquid refrigerant and the coolant;

c) a first pressure sensing means, interposed between the compression means and the mixing means, for measuring the pressure of the refrigerant;

d) a second pressure sensing means, interposed between the first heat exchange means and the mixing means, for measuring the pressure of the coolant; and e) a controlling means, connected to the first temperature sensing means, the second temperature sensing means, the first pressure sensing means, the second pressure sensing means, the compression means, and the pump means, for determining the actual temperature difference between the measurements of the first temperature sensing means and the second temperature sensing means and for adjusting the pressure of the refrigerant vapor exiting the compression means and the coolant exiting the pump means.

10. A closed cooling system, comprising:

a) Refrigerant 22 for circulating within the closed system;

b) Polyalphaolefin for circulating within the closed system;

c) a means for separating the Refrigerant 22 from the Polyalphaolefin which is operable in any orientation and in any gravitational situation;

d) a pump means, coupled to the separating means, for providing motive force to the Polyalphaolefin;

e) a plurality of first single-phase heat exchange means, connected downstream of the pump means, for allowing the Polyalphaolefin to absorb heat from a cooling load;

f) a compression means, coupled to the separating means, for increasing the pressure of a vapor of the Refrigerant 22;

g) a means, connected to both the compression means and the first single-phase heat exchange means, for mixing the vapor of the Refrigerant 22 and the Polyalphaolefin so as to condense the Refrigerant 22 vapor which is operable in any orientation and in any gravitational situation;

h) a plurality of second single-phase heat exchange means, coupled downstream of the mixing means, for releasing heat from a mixture of liquid Refrigerant 22 and Polyalphaolefin to a heat sink; and i) a means, interconnected between the second single-phase heat exchange means and the separating means, for decreasing the pressure of a mixture of the liquid Refrigerant 22 and the Polyalphaolefin so as to vaporize the liquid Refrigerant 22;

j) a first temperature sensing means, connected to the second heat exchange means, for measuring the temperature of the heat sink;

k) a second temperature sensing means, interposed between the mixing means and the second heat exchange means, for measuring the temperature of the mixture of the liquid refrigerant and the coolant;

l) a first pressure sensing means, interposed between the compression means and the mixing means, for measuring the pressure of the refrigerant;

m) a second pressure sensing means, interposed between the first heat exchange means and the mixing means, for measuring the pressure of the coolant; and n) a controlling means, connected to the first temperature sensing means, the second temperature sensing means, the first pressure sensing means, the second pressure sensing means, the compression means, and the pump means, for determining the actual temperature difference between the measurements of the first temperature sensing means and the second temperature sensing means and for adjusting the pressure of the refrigerant vapor exiting the compression means and the coolant exiting the pump means.

11. A closed system for cooling a load as recited in claim 10, wherein the separating means is mechanically induced.

12. A closed system for cooling a load as recited in claim 11, wherein the separating means is a centrifuge.

13. A closed system for cooling a load as recited in claim 11, wherein the separating means is created by vortex flow.

14. A method for cooling a load, comprising the steps of:

a) separating a liquid coolant from a vapor of a refrigerant;

b) pumping the liquid coolant;

c) absorbing heat from a cooling load by the liquid coolant;

d) compressing the refrigerant vapor;

e) mixing the liquid coolant and the refrigerant vapor so as to condense the refrigerant vapor to a refrigerant liquid;

f) releasing heat from the liquid coolant and the liquid refrigerant to a heat sink; and g) decreasing the pressure of the liquid coolant and the liquid refrigerant so as to vaporize the liquid refrigerant prior to the separating step.

15. A method for cooling a load as recited in claim 14, wherein the step of separating is mechanically induced.

16. A method for cooling a load as recited in claim 15, wherein the step of separating is performed by a centrifuge.

17. A method for cooling a load as recited in claim 15, wherein the step of separating is created by vortex flow.

18. A method for cooling a load as recited in claim 14, wherein the step of decreasing the pressure is performed by an expansion valve.

19. A method for cooling a load as recited in claim 14, further comprising the steps of:

a) measuring the temperature of the heat sink;

b) measuring the temperature of the liquid coolant and the liquid coolant following the mixing step;

c) measuring the pressure of the refrigerant vapor following the compressing step;

d) measuring the pressure of the liquid coolant following the absorbing step:

e) adjusting the pressure of the liquid coolant in the pumping step and the pressure of the refrigerant vapor in the compressing step so as to maintain the pressure of the coolant and the refrigerant at the minimum pressure necessary to release all the heat absorbed from the cooling load to the heat sink.

* * * * *